United States Patent [19]

Fleck

[11] Patent Number: 4,867,846

[45] Date of Patent: Sep. 19, 1989

[54] APPARATUS FOR FEEDING WOOD CHIPS TO A TREATMENT BIN

[75] Inventor: John A. Fleck, Roswell, Ga.

[73] Assignee: Champion International Corporation, N.Y.

[21] Appl. No.: 249,662

[22] Filed: Sep. 27, 1988

[51] Int. Cl.[4] ..... D21C 7/06

[52] U.S. Cl. ..... 162/246; 162/18; 162/52; 222/286; 222/311; 222/413; 239/651; 414/288; 414/301; 414/306

[58] Field of Search ..... 162/18, 52, 246, 236, 162/237; 222/286, 311, 353, 413; 414/301, 302, 288, 306; 239/651, 687

[56] References Cited

U.S. PATENT DOCUMENTS

| | | | |
|---|---|---|---|
| 895,489 | 8/1908 | Morse | 222/286 |
| 1,104,288 | 7/1914 | Beskow et al. | 222/286 |
| 2,100,315 | 11/1937 | Harper | 222/286 |
| 2,329,948 | 9/1943 | Shallock | 222/286 |
| 2,459,180 | 1/1949 | Richter | 162/18 |
| 2,468,712 | 4/1949 | Kohler | 222/286 |
| 3,703,435 | 11/1972 | Schleinofer | 162/52 |
| 4,071,399 | 1/1978 | Prough | 162/18 |
| 4,120,410 | 10/1978 | Burgt | 414/301 |
| 4,653,674 | 3/1987 | Kihara et al. | 222/342 |

*Primary Examiner*—Karen Hastings

*Attorney, Agent, or Firm*—Evelyn M. Sommer

[57] ABSTRACT

Apparatus for feeding wood chips and the like into a treatment bin includes a feed tube assembly adapted to lead into the bin at a non-zero angle relative to the horizon. A plate is supported underneath the lower end of the feed tube assembly to collect in a mound wood chips fed through the feed tube. The height of the lower end of the feed tube assembly is adjusted so that the lower end of the feed tube assembly engages the mound of wood chips and thereby forms a seal with the mound. A plow is supported between the plate and the lower end of the feed tube assembly. Either the plate is stationary and the plow rotates or the plow is stationary and the plate rotates to knock wood whips from the mound off the plate. The apparatus optionally includes a feed screw mounted within and longitudinally of the feed tube assembly to compress the wood chips into the mound.

4 Claims, 3 Drawing Sheets

APPARATUS FOR FEEDING WOOD CHIPS TO A TREATMENT BIN

BACKGROUND OF THE INVENTION

The invention relates generally to apparatus for feeding wood chips and the like into a treatment bin, and deals more particularly with such apparatus which maintains a seal with the bin to prevent gases from escaping.

In the course of manufacturing certain wood products, wood chips are fed into a bin where they are presteamed or otherwise treated with chemicals. At all times, it is important to prevent the steam and other gases within the bin from escaping, and the air outside from entering into the bin. Thus, the wood chips should be fed into the bin through a suitable seal.

For example, Kamyr Aktiebolag, a company located in Karlstad, Sweden, has manufactured and sold a feeder with a rotary pocket air lock to provide the seal, and a horizontal screw conveyor to feed the wood chips into the bin. Although this feeder is effective, it requires closely fitting parts to maintain the seal, and the parts are subject to wear and require maintenance.

Accordingly, a general object of the present invention is to provide a wood chip feeder which does not require closely fitting parts to make a seal, yet is effective in both feeding the wood chips and providing the seal.

Another general object of the present invention is to provide a wood chip feeder of the foregoing type which requires little maintenance.

A more specific object of the present invention is to provide wood chip feeders of the foregoing types which provide the seal even when wood chips are not fed into the bin.

SUMMARY OF THE INVENTION

The invention resides in an apparatus for feeding wood chips and the like into a treatment bin. The feeder includes a feed tube assembly adapted to lead into the bin at a non-zero angle relative to the horizon. A support surface is located underneath the lower end of the feed tube assembly to collect in a mound wood chips fed through the feed tube assembly. The distance between the lower end of the feed tube assembly and the support surface is set such that the lower end of the feed tube assembly engages the mound of wood chips and thereby forms a seal with the mound. Consequently, the length of the feed tube assembly need not be manufactured to small tolerance, and little maintenance is required.

According to one feature of the invention, the support surface comprises a plate supported above a floor of the treatment bin. The feed tube assembly comprises an upper tube mounted at a fixed height in the treatment bin and a lower tubular skirt which is longitudinally and slidably mounted to the exterior of the sidewall of the upper tube.

In one embodiment of the invention, the plate is stationary and a plow is revolved between the plate and the lower end of the feed tube assembly to knock wood chips off the plate and throughout the bin. In another embodiment of the invention, the plate is rotated, and a stationary plow is mounted between the plate and the lower end of the feed tube assembly to knock wood chips off the plate.

DETAILED DESCRIPTION OF THE PREFERRED EMBODIMENTS

Figure 1:
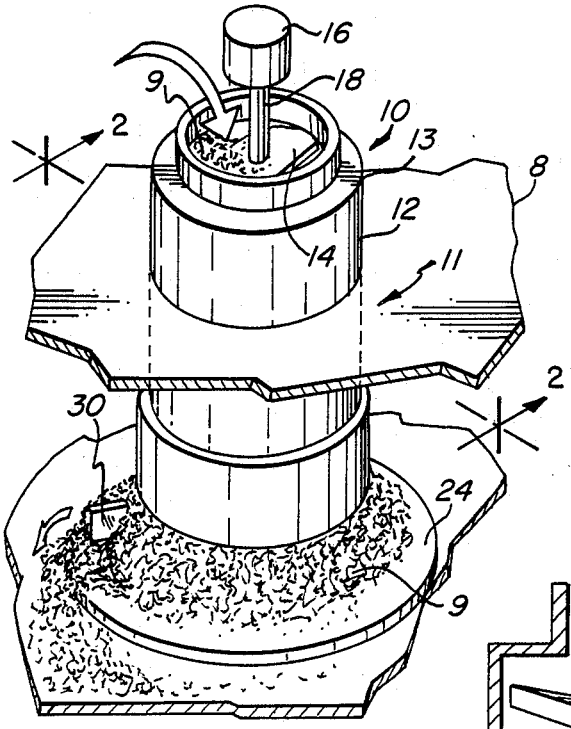
FIG. 1 is a fragmentary, perspective view of a pretreatment bin for wood chips and a wood chip feeder in accordance with the present invention.

Referring now to the Figures in detail wherein like reference numerals indicate like elements throughout the several views, FIG. 1 illustrates a bin generally designated 8 for pre-treating wood chips 9 with steam and/or other chemicals in the course of manufacturing wood products and the like. It should be understood that the term "wood chips" as used throughout this patent application encompasses not only cellulosic fiber materials such as hewn wood chips but also a wide variety of other comminuted fibrous materials. FIG. 1 also illustrates a feeder generally designated 10 for the wood chips, which feeder includes a feed tube assembly 11 and an optional feed screw 14 driven by a motor 16 via drive shaft 18. Feed tube assembly 11 comprises a guide tube or pipe 12 and a tubular skirt 40 located at the lower end of the pipe. Tube 12 is received in sealing engagement in a hole 13 in a top of bin 8.

Figure 2:
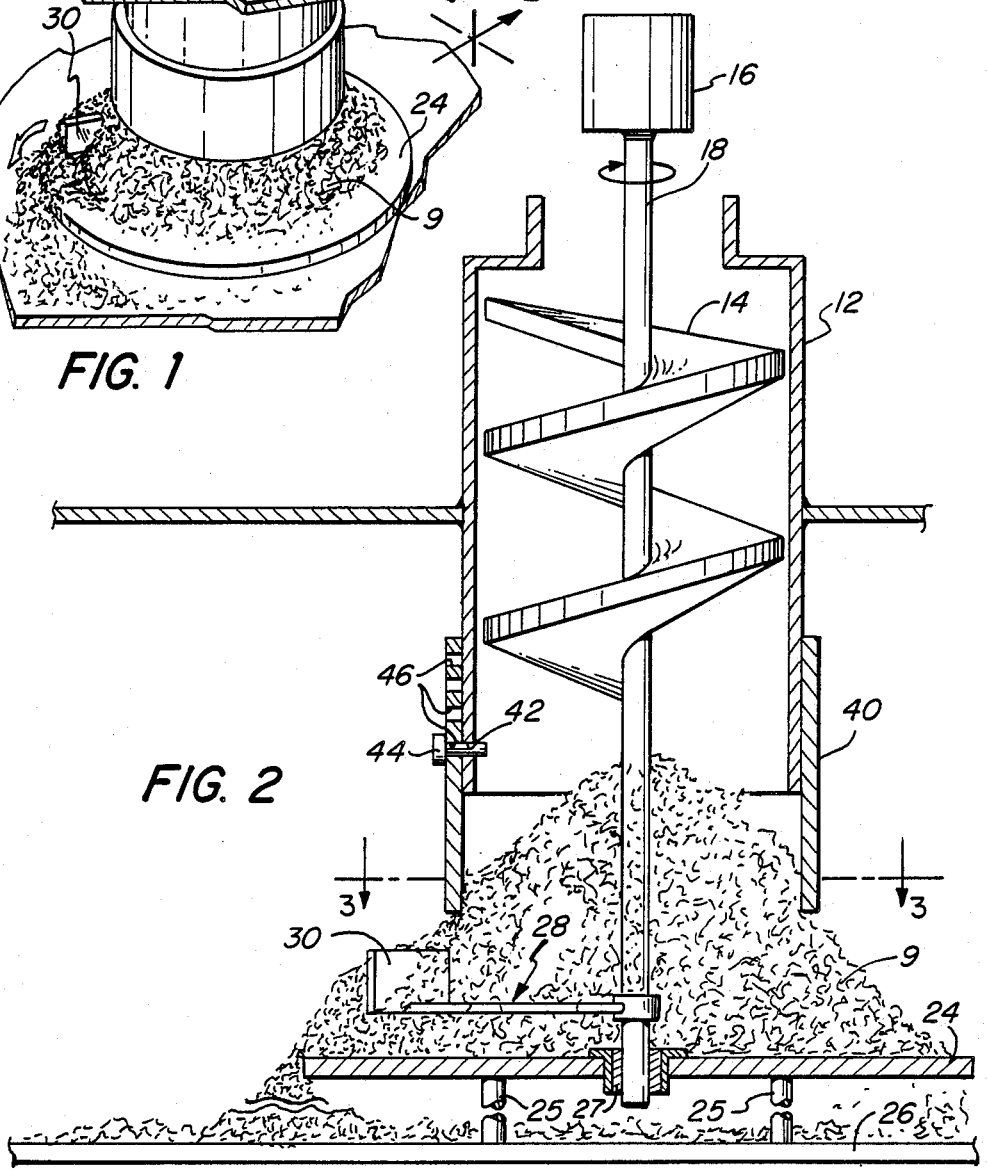
FIG. 2 is a view in cross section of the wood chip bin and feeder taken along the plane indicated by line 2—2 of FIG. 1.
Figure 3:
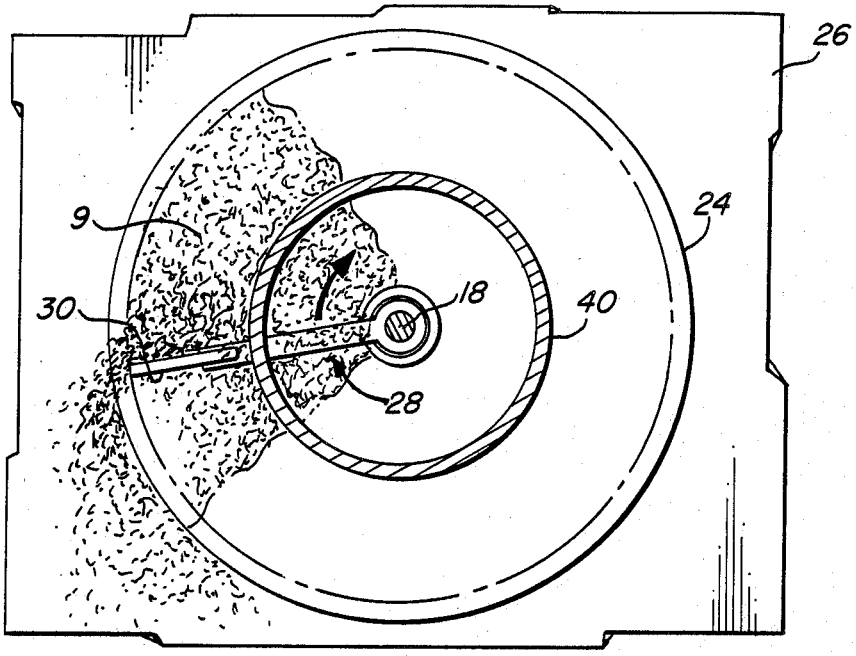
FIG. 3 is a view in cross section of the wood chip bin and feeder taken along the plane indicated by line 3—3 of FIG. 2.

As further illustrated in FIGS. 2 and 3, feeder 10 also includes a stationary plate 24 supported beneath tube 12 by legs 25 mounted on a floor 26 of bin 8. The bottom end of drive shaft 18 is rotatably mounted to plate 24 by a bearing 27. Plate 24 is perpendicular to the axis of tube 12 and the wood chips fed into tube 12 collect on plate 24 in a mound. If the optional feed screw 14 is included in feeder 10, then the mound is compressed by the downward force which the feed screw exerts on the wood chips passing through tube 12. A plow, generally designated 28, is mounted to and driven by drive shaft 18 between plate 24 and tube 12. Plow 28 includes a blade 30 which revolves in a plane generally parallel to plate 24 and knocks wood chips 9 from the mound off the plate and throughout bin 8. Thus, feeder 10 serves to distribute the wood chips throughout the bin to facilitate reaction with the steam and/or other chemicals.

The skirt 40 provides a seal between the mound of wood chips 9 and tube 12 so that the steam and/or other chemicals within the bin do not freely escape, and outside air does not freely enter into the bin. Gases cannot readily pass through the mound. In the embodiment illustrated in FIGS. 1–3, skirt 40 has a circular cross section and a diameter slightly greater than that of tube 12 so that skirt 40 is longitudinally slidable along the exterior of the sidewall of tube 12 while providing a seal between its sidewall and that of tube 12. Tube 12 has a radial hole 42 in its sidewall to receive a bolt 44, and skirt 40 has a plurality of longitudinally spaced, radial holes 46 also to receive bolt 44 and thereby secure the skirt at a desired, adjustable height above plate 24. In FIGS. 2 and 3, bolt 44 is received in the lowermost hole 46 so that skirt 40 is secured in its uppermost position. It should be apparent that if instead bolt 44 was received in one of the other holes 46, then skirt 40 would be secured in a lower position. According to the present invention, skirt 40 is secured at a height such that the lower end of the skirt engages the mound of wood chips 9 and thereby forms an effective seal or barrier between the remainder of the interior of bin 8 and the interior portion of tube 12 which is in communication with the external environment. Thus, skirt 40 at this height prevents the steam and/or other gases within the bin from escaping and outside air from entering into the bin. Because the height of skirt 40 is adjustable and the mound of wood chips is malleable, skirt 40 need not be manufactured or maintained at a precise length.

It should be noted that when additional wood chips are fed into tube 12, they fall on top of the mound, and simultaneously, plow 8 as well as gravity and the optional feed screw cause wood chips to fall off plate 24 so that the height of the mound stays within a range assuring an adequate seal with skirt 40. The seal is also maintained when the wood chips cease flowing into tube 12 because without the added weight on the mound of wood chips, few of the wood chips are either knocked or fall off plate 24. To minimize the number of wood chips removed from plate 24 when the flow of wood chips into tube 12 is shut off, motor 16 may be deactivated to halt plow 28 and the optional feed screw. The treated wood chips are output from bin 8 via a conventional outlet (not shown).

Figure 4:
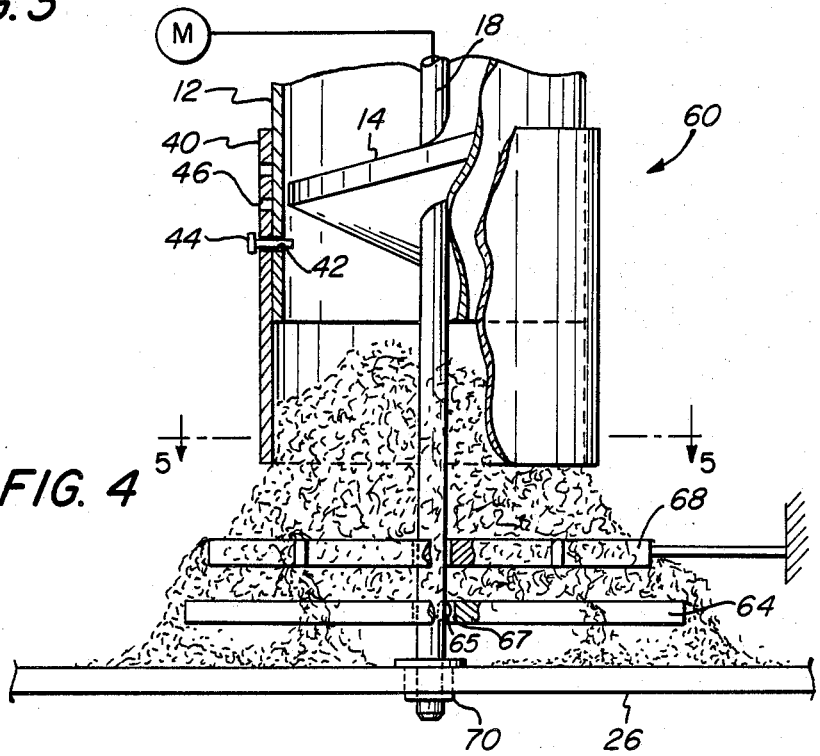
FIG. 4 is a fragmentary view in cross section of the bin of FIG. 1 and another wood chip feeder in accordance with the present invention, which view is taken along a plane longitudinal of the feeder.
Figure 5:
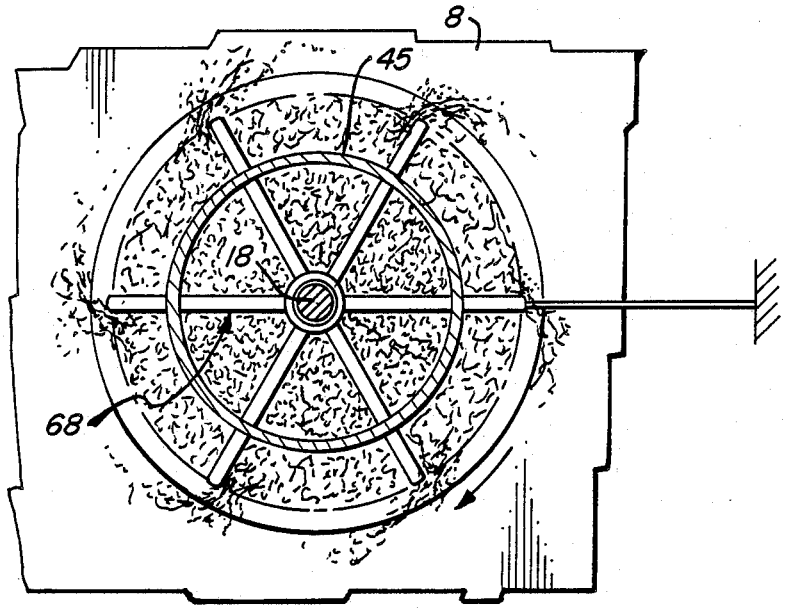
FIG. 5 is a view in cross section of the wood chip bin and feeder taken along the plane indicated by line 5—5 of FIG. 4.

FIGS. 4 and 5 illustrate another feeder generally designated 60 in accordance with another embodiment of the present invention. Feeder 60 is identical to feeder 10 except for the following. Instead of stationary plate 24 and revolving plow 28, feeder 60 includes rotating plate 64 driven by drive shaft 18, and a stationary bar or plow 68 to knock the wood chips off the rotating plate. Drive shaft 18 is coupled to plate 64 by a key 65 protruding radially of the drive shaft and received in a slot 67 in plate 64. The lower end of drive shaft 18 is rotatably mounted in bearing 70 in the floor of bin 8. Stationary plow 68 may comprise a single, straight bar or a star-shaped assembly as illustrated to distribute the wood chips more evenly through the treatment bin 8.

By the foregoing, wood chip feeders embodying the present invention have been disclosed. However, numerous modifications and substitutions may be made without deviating from the scope of the invention. For example, if desired, instead of holes 42, 46 and bolt 44 for adjusting the height of skirt 40, skirt 40 may be provided with a single threaded aperture and a mating bolt which is turned against tube 12 to set skirt 40 at a desired height. Alternately, neither tube 12 or skirt 40 is provided with any aperture or bolt, and skirt 40 is biased by gravity or by a spring against the mound of wood chips 9. Also, if desired, the height of either plate 24 or 64 can be adjustable instead of skirt 40 to secure the seal, or the height of tube 12 can be adjustable and skirt 40 omitted from the feed tube assembly. Moreover, if desired, plates 24 and 64 can be omitted, and the feed tube assemblies lowered to engage a mound formed on the floor of the treatment bin.

Also, as noted above, the feed screw 14 in both embodiments of the invention is optional and, if desired, may be omitted so that gravity alone forms wood chips 9 into the mound. In such case, motor 16 and drive shaft 18 are still provided to drive either plow 28 or plate 64. Moreover, if desired, tube 12 and the remainder of feeders 10 and 60 may be angled from the vertical. Therefore, the invention has been disclosed by way of illustration and not limitation, and reference should be made to the following claims to determine the scope of the invention.

I claim:

1. In a treatment bin having a floor, an apparatus for feeding comminuted fiberous material into the bin, said apparatus comprising:

a feed tube assembly having a first end external to said bin and a second end leading into said bin and being spaced from the floor thereof, said feed tube assembly being aligned for gravitationally feeding the comminuted fibrous material into the bin;

support means intermediate and spaced from both the second end of said feed tube assembly and the floor of said bin for receiving the comminuted fibrous materials fed through said feed tube assembly;

material feed means for feeding the comminuted fibrous material into the bin, said material feed means comprising a first portion rotatably disposed within said feed tube assembly for urging the comminuted fibrous materials toward the support means and a second portion mounted to said first portion and rotatable therewith, said second portion of said feed means being displaced within said bin and external to said feed tube assembly for urging selected portions of the comminuted fibrous material from the support means and towards the floor of said bin; the first portion of the feed means comprises a feed screw rotatably disposed within said feed tube, the second portion of the feed means comprises a plow rotatably mounted intermediate said feed tube and said support means for urging selected portions of said comminuted fiberous material from said support means and toward the floor of said bin; and adjusting means for adjusting the distance between the second end of said feed tube assembly and said support means, whereby the distance between the second end of the feed tube assembly and the support means is adjusted to maintain a mound of the comminuted fibrous material therebetween for substantially sealing the bin.

2. In a treatment bin having a floor, an apparatus for feeding comminuted fiberous material into the bin, said apparatus comprising:

a feed tube assembly having a first end external to said bin and a second end leading into said bin and being spaced from the floor thereof, said feed tube assembly being aligned for gravitationally feeding the comminuted fibrous material into the bin;

support means intermediate and spaced from both the second end of said feed tube assembly and the floor of said bin for receiving the comminuted fibrous materials fed through said feed tube assembly;

material feed means for feeding the comminuted fibrous material into the bin, said material feed means comprising a first portion rotatably disposed within said feed tube assembly for urging the comminuted fibrous materials toward the support means and a second portion mounted to said first portion and rotatable therewith, said second portion of said feed means being disposed within said bin and external to said feed tube assembly for urging selected portions of the comminuted fibrous material from the support means and towards the floor of said bin; the first portion of the feed means comprises a feed screw rotatably disposed within said feed tube, said feed means further comprises a drive shaft, said feed screw being rigidly mounted to said drive shaft, said drive shaft extending within said bin and being rigidly connected to said support means such that said support means is rotatable with said drive shaft and said feed screw to define the second portion of the feed means, said feed means further comprising a plow non-rotatably mounted intermediate said support means and said feed tube for urging selected portions of said comminuted fibrous materials from the rotatable support means; and adjusting means for adjusting the distance between the second end of said feed tube assembly and said support means, whereby the distance between the second end of the feed tube assembly and the support means is adjusted to maintain a mound of the comminuted fiberous material therebetween for substantially sealing the bin.

3. An apparatus as in claims 1 or 2 wherein the adjusting means comprises a generally tubular skirt adjustably mounted to the second end of said feed tube assembly.

4. An apparatus as in claim 1 wherein the feed means further comprises a rotatable drive shaft, said feed screw and said plow being mounted to and rotatably driven by said drive shaft.

* * * * *